US008511649B1

(12) United States Patent
Chang

(10) Patent No.: US 8,511,649 B1
(45) Date of Patent: Aug. 20, 2013

(54) ENGINE MODEL CARBURETOR

(75) Inventor: Lien-Sheng Chang, Taichung (TW)

(73) Assignee: Golden Lion Enterprise Co., Ltd., Taichung (TW)

( * ) Notice: Subject to any disclaimer, the term of this patent is extended or adjusted under 35 U.S.C. 154(b) by 0 days.

(21) Appl. No.: 13/603,644

(22) Filed: Sep. 5, 2012

(30) Foreign Application Priority Data

May 23, 2012 (TW) ..... 101209761 A

(51) Int. Cl.
*F02M 7/12* (2006.01)

(52) U.S. Cl.
USPC ..... 261/35; 261/66; 261/69.1; 261/DIG. 38; 261/DIG. 68

(58) Field of Classification Search
USPC ..... 261/34.1, 35, 66, 69.1, 69.2, DIG. 8, 261/DIG. 38, DIG. 68
See application file for complete search history.

(56) References Cited

U.S. PATENT DOCUMENTS 3,738,336 A * 6/1973 Holland ..... 123/73 R
4,104,994 A * 8/1978 Phillips ..... 123/73 R
4,168,288 A * 9/1979 Nau et al. ..... 261/35
4,578,228 A * 3/1986 Gerhardy ..... 261/41.5
5,283,013 A * 2/1994 Gerhardy ..... 261/35
6,042,088 A * 3/2000 Wang ..... 261/39.1
6,938,884 B2 * 9/2005 Knaus et al. ..... 261/34.2
7,364,138 B2 * 4/2008 Prager ..... 261/34.2
2003/0222357 A1 * 12/2003 Braun et al. ..... 261/35
2004/0256744 A1 * 12/2004 Geyer et al. ..... 261/35

FOREIGN PATENT DOCUMENTS

JP 62-38859 A * 2/1987 ..... 261/66

* cited by examiner

*Primary Examiner* — Richard L Chiesa
(74) *Attorney, Agent, or Firm* — Ming Chow; Sinorica, LLC

(57) ABSTRACT

A model engine carburetor capable of adjusting oil automatically when decelerating is mounted on a model engine. The model engine carburetor has a first adjustment room and a second adjustment room. The first adjustment room and the second adjustment are separated by an elastic membrane. When the model engine is decelerated at a very short time from a high speed, the model engine will generate negative pressure to draw out the air in the first adjustment room and the elastic membrane will be deformed to generate vacuum suction. The overmuch fuel oil is drawn to the second adjustment room to adjust the ratio of the oil gas. The model engine can run smoothly when the speed is decelerated at a very short time.

3 Claims, 11 Drawing Sheets

ENGINE MODEL CARBURETOR

The current application claims a foreign priority to the patent application of Taiwan No. 101209761 filed on May 23, 2012.

BACKGROUND OF THE INVENTION

1. Field of the Invention

The present invention relates to an engine model carburetor, and more particularly to, an engine model carburetor capable of adjusting oil automatically when decelerating.

2. Description of the Prior Art

FIG. 1 is a partial sectional view of a conventional model engine. FIG. 2 is a sectional view of a conventional model engine carburetor. The model engine comprises a cylinder 1. The cylinder 1 comprises a piston 2 therein. The cylinder 1 is further connected with a carburetor 3. The carburetor 3 has an air passage 4 therein, and a first connection hole 5 and a second connection hole 6 to communicate with the air passage 4. A middle-speed oil needle 7 is provided in the first connection hole 5. A throttle 8 is provided in the second connection hole 6. An oil supply valve 9 is provided at an outer side of the carburetor 3. The oil supply valve 9 communicates with the middle-speed oil needle 7. Fuel oil is first poured in the oil supply valve 9, and then flows to the middle-speed oil needle 7. When the user starts the model engine, the negative pressure generated by the piston 2 will draw the external air to enter the cylinder 1 through the air passage 4 of the carburetor 3. Because the passage C defined between the middle-speed oil speed 7 and the throttle 8 is smaller than the air passage 4, the air passing the passage C will accelerate to form negative pressure. Through the Bernoulli principle, the fuel oil in the middle-speed oil needle 7 is drawn to the air passage 4 to mix with the air to form oil gas. Then, the oil gas enters the cylinder 1 for ignition to push the piston 2 to reciprocate.

Referring to FIG. 1 and FIG. 2, the user controls the distance between the middle-speed oil needle 7 and the throttle 8 to change the size of the passage C so as to control the air flow entering the air passage 4 to adjust the rotation speed of the piston 2. For example, the throttle 8 is moved away from the middle-speed oil needle 7 to enlarge the passage C so as to increase the air flow entering the air passage 4, such that the rotation speed of the piston 2 is increased. However, the running of the model engine is not in sequence. Sometimes, the speed is decelerated at a very short time from a high speed. It is named oil-return. At this time, the throttle 8 will slide toward the middle-speed oil needle 7 quickly to reduce the passage C quickly, so that the air flow entering the air passage 4 will be decreased greatly. The fuel oil ratios of the oil gas is too high, namely, the oil gas is too thick. When this kind of oil gas enters the cylinder 1, the model engine will not run smoothly to accumulate carbon in the cylinder 1 and to waste the fuel oil. The model engine may extinguish. Accordingly, the inventor of the present invention has devoted himself based on his many years of practical experiences to solve these problems.

SUMMARY OF THE INVENTION

The primary object of the present invention is to provide an engine model carburetor to ensure that the engine model carburetor can run smoothly when the speed is decelerated at a very short time and to prevent the model engine from extinguishing because the oil gas is too thick In order to achieve the aforesaid object, the engine model carburetor of the present invention comprises a main body. The main body has an air passage therein. The main body further has a first connection hole communicating with the air passage. The first connection hole is adapted for connection of a middle-speed oil needle. The main body further has a second connection hole communicating with the first connection hole. The second connection hole is adapted for connection of an oil supply valve. The main body further has a third connection hole communicating with the air passage. The third connection hole is adapted for connection of a throttle. One side of the main body has a recess with a bottom and a side wall. The main body further has a first adjustment channel therein. The first adjustment channel has two ends to respectively communicate with the air passage and the recess. The main body further has a second adjustment channel therein. The second adjustment channel has two ends to respectively communicate with the middle-speed oil needle and the recess. An elastic membrane is provided in the recess. A first adjustment room is defined between the elastic membrane and the bottom. The first adjustment room communicates with the first adjustment channel. A cover is provided to cover an outer side of the recess. A second adjustment room is defined between the cover and the elastic membrane. The second adjustment room communicates with the second adjustment channel.

The model engine carburetor is mounted on a model engine. When the model engine is decelerated at a very short time from a high speed, the model engine will generate negative pressure to draw out the air in the first adjustment room, such that the elastic membrane is deformed to generate vacuum suction. The fuel oil in the middle-speed oil needle is drawn to the second adjustment room through the second adjustment channel to decrease the oil jetted from the middle-speed oil needle so as to adjust the ratio of the oil gas, preventing the oil gas from being too thick. Thus, the model engine can run smoothly when the speed is decelerated at a very short time. The present invention prevents the model engine from extinguishing because the oil gas is too thick, and reduces the carbon accumulated in the cylinder to save the fuel oil.

DETAILED DESCRIPTION OF THE PREFERRED EMBODIMENTS

Embodiments of the present invention will now be described, by way of example only, with reference to the accompanying drawings.

Figure 1:
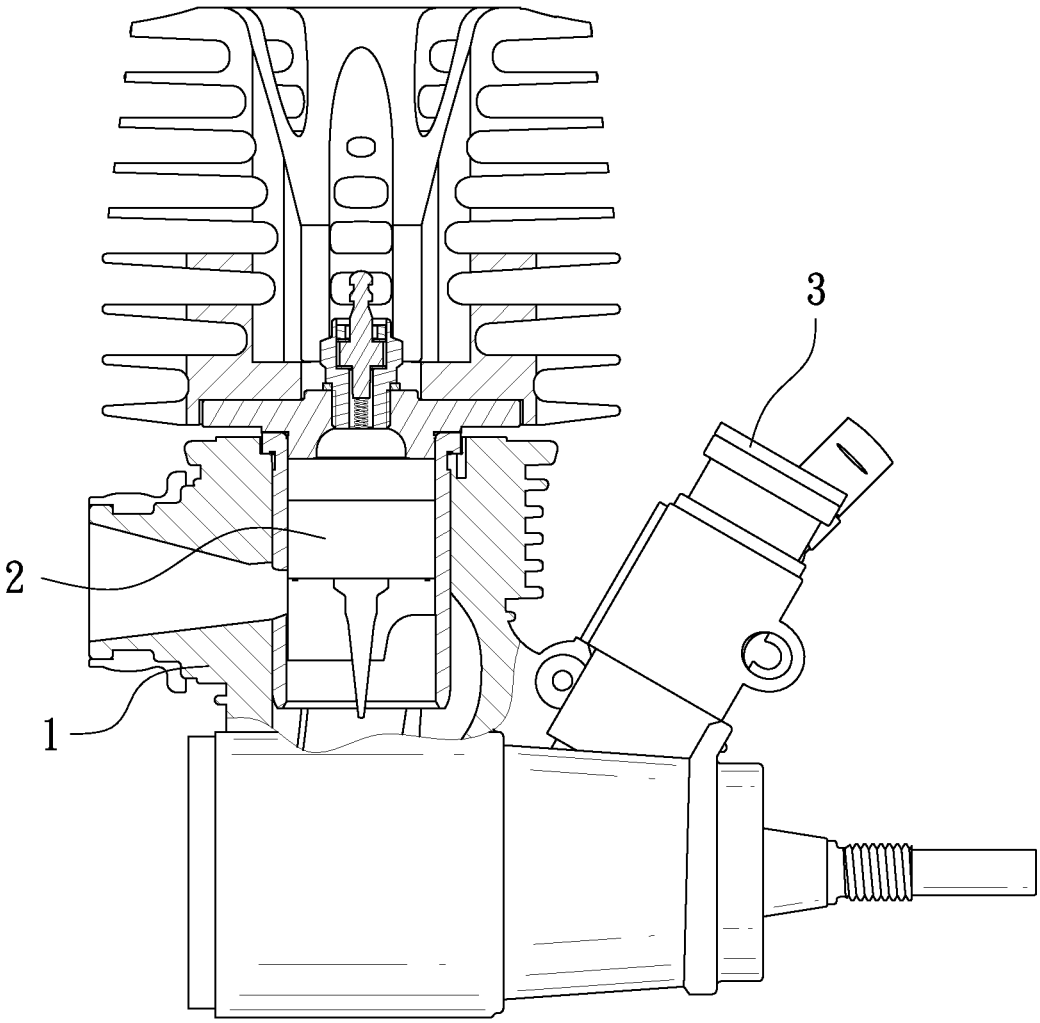
FIG. 1 PRIOR ART
FIG. 1 is a partial sectional view of a conventional model engine.
Figure 2:
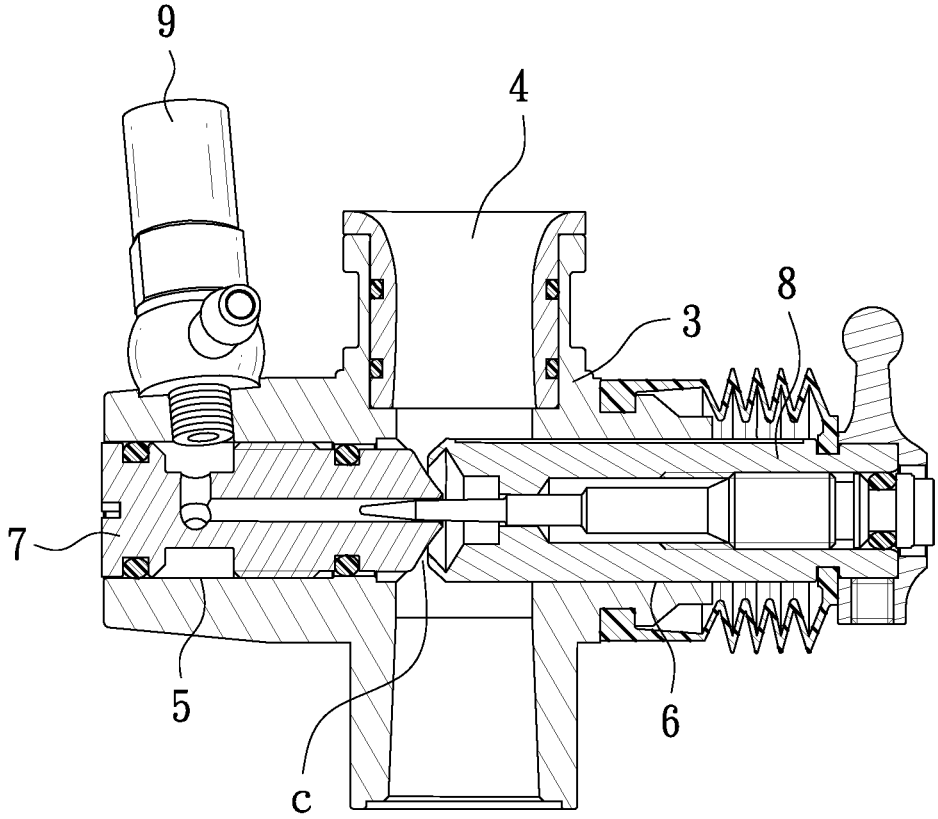
FIG. 2 PRIOR ART
FIG. 2 is a sectional view of a conventional model engine carburetor.
Figure 3:
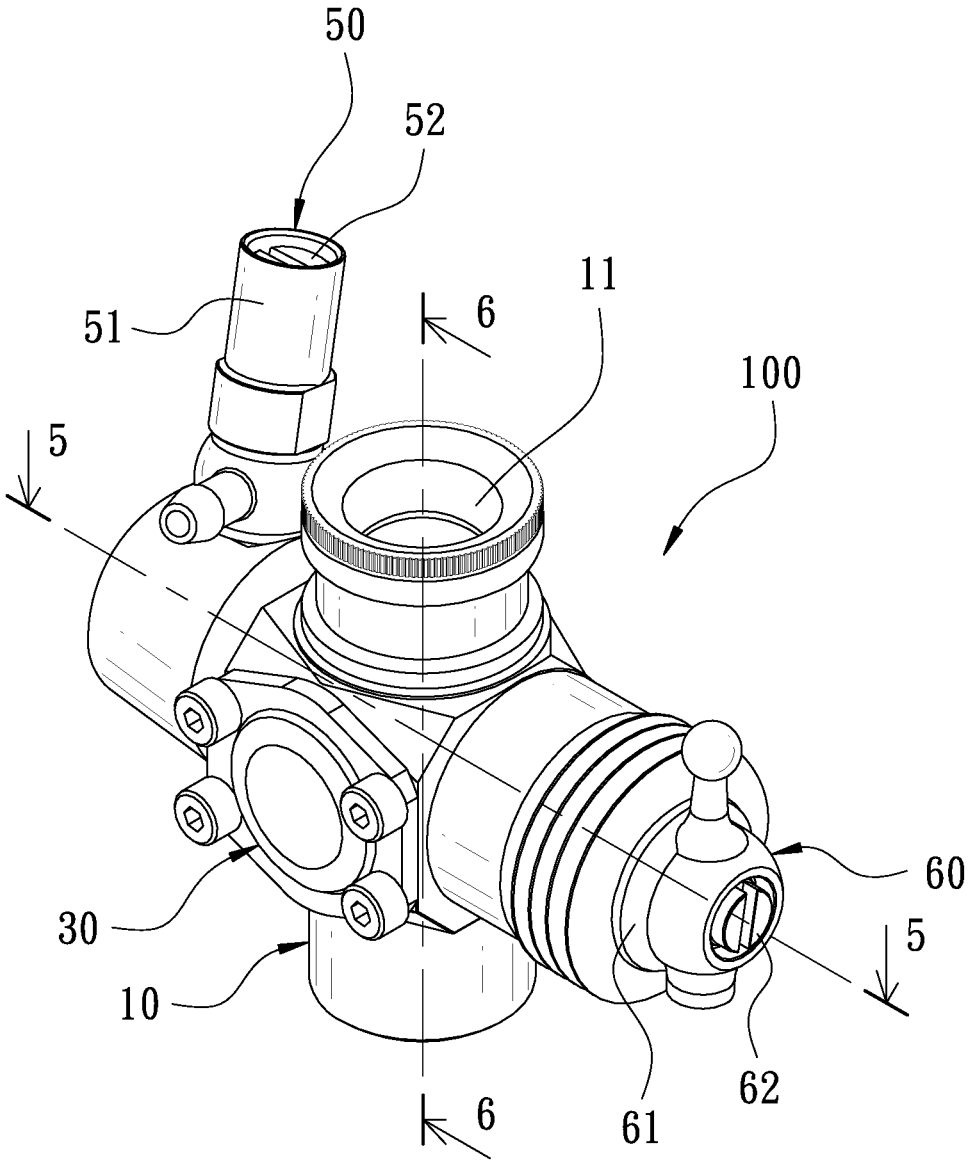
FIG. 3 is a perspective view according to a preferred embodiment of the present invention.
Figure 4:
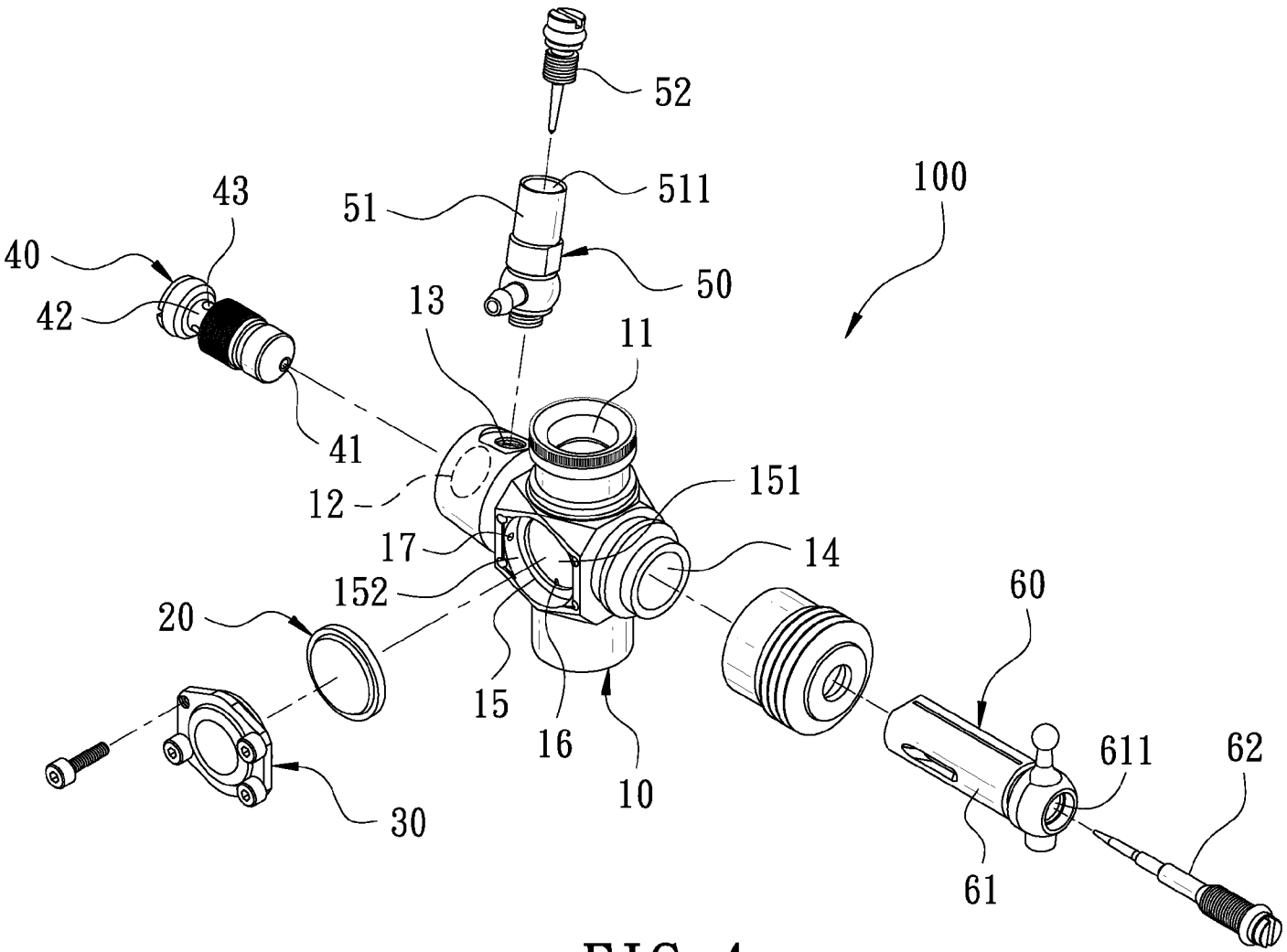
FIG. 4 is an exploded view according to the preferred embodiment of the present invention.
Figure 5:
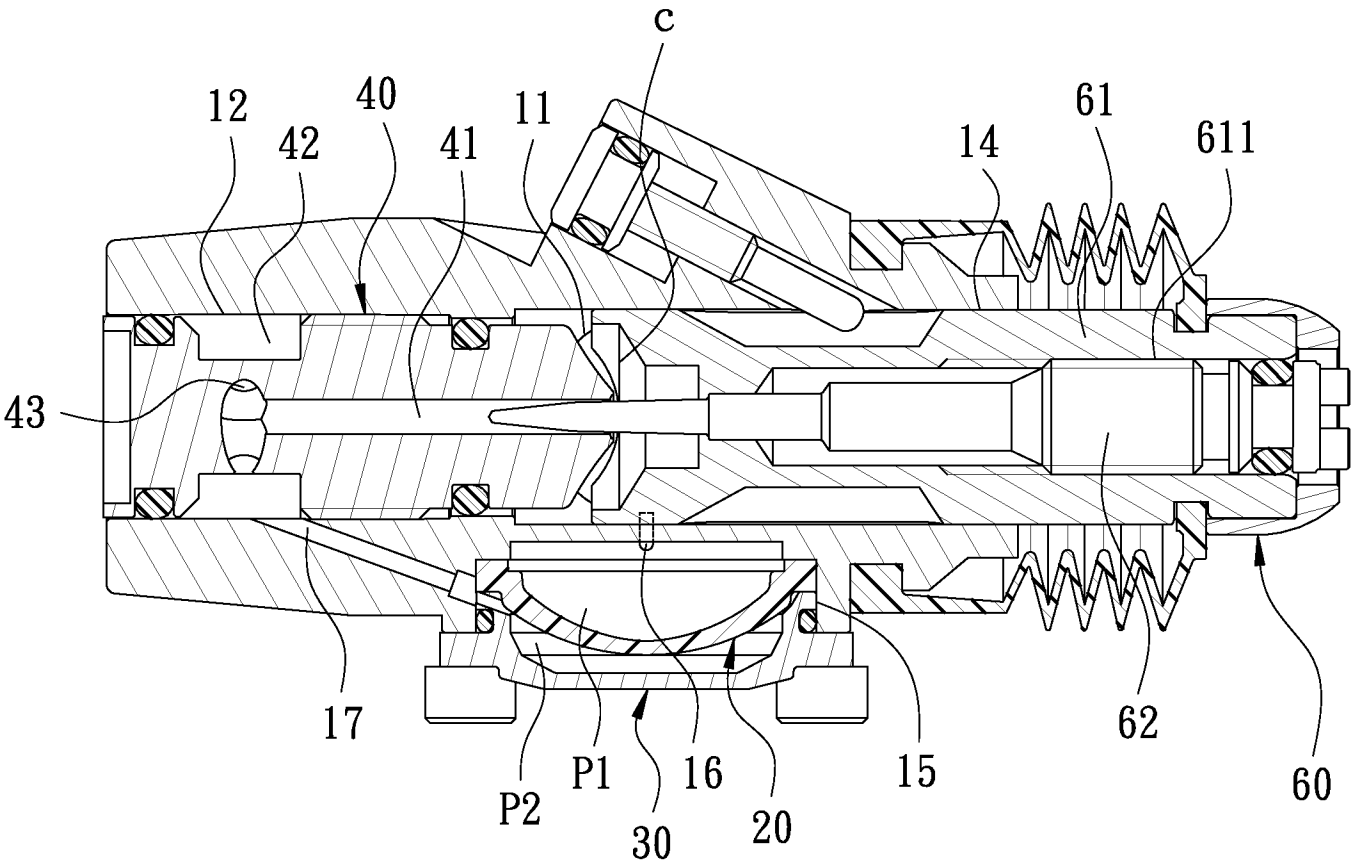
FIG. 5 is a sectional view taken along line 5-5 of FIG. 3.
Figure 6:
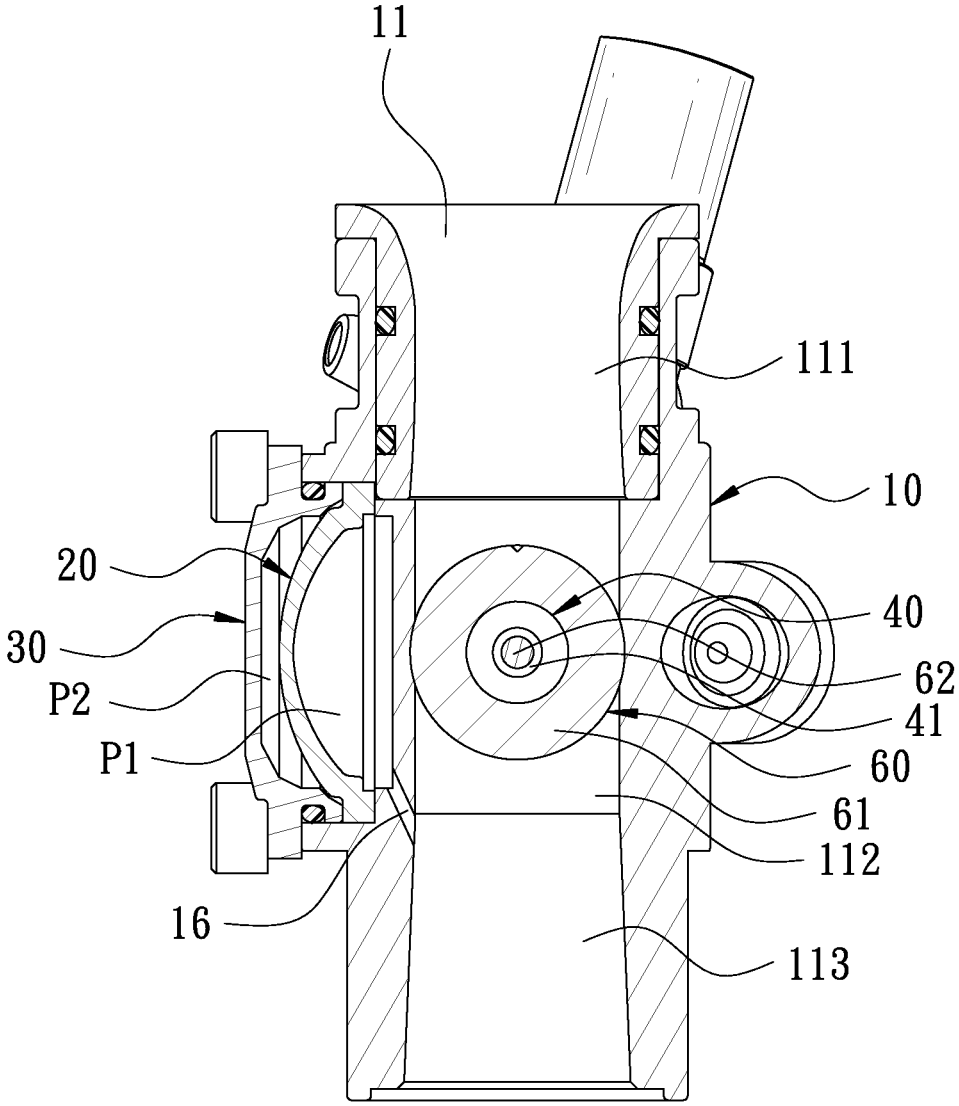
FIG. 6 is a sectional view taken along line 6-6 of FIG. 3.

FIG. 3 is a perspective view according to a preferred embodiment of the present invention. FIG. 4 is an exploded view according to the preferred embodiment of the present invention. FIG. 5 is a sectional view taken along line 5-5 of FIG. 3. FIG. 6 is a sectional view taken along line 6-6 of FIG. 3. The present invention discloses an engine model carburetor 100 capable of adjusting the amount of oil automatically. The engine model carburetor 100 comprises a main body 10, an elastic membrane 20, a cover 30, a middle-speed oil needle 40, an oil supply valve 50, and a throttle 60.

The main body 10 has an air passage 11 therein. As shown in FIG. 6, the air passage 11 has an inlet section 111, a middle section 112 and an outlet section 113 in an axial direction. The middle section 112 is located between the inlet section 111 and the outlet section 113. The middle section 112 has an inner diameter smaller than those of the inlet section 111 and the outlet section 113. The main body 10 further has a first connection hole 12 communicating with the air passage 11, a second connection hole 13 communicating with the first connection hole 12, and a third connection hole 14 communicating with the air passage 11. One side of the main body 10 has a recess 15 with a bottom 151 and a side wall 152. The main body 10 further has a first adjustment channel 16 therein. One end of the first adjustment channel 16 communicates with the joint of the middle section 112 and the outlet section 113, and the other end of the first adjustment channel 16 communicates with the bottom 151 of the recess 15. The main body 10 further has a second adjustment channel 17 therein. One end of the second adjustment channel 17 communicates with the first connection hole 12, and the other end of the second adjustment channel 17 communicates with the side wall 152 of the recess 15.

The elastic membrane 20 is disposed in the recess 15 and the circumferential edge of the elastic membrane 20 is against the side wall 52 of the recess 15, such that a first adjustment room P1 is defined between the elastic membrane 20 and the bottom 151. The first adjustment room P1 communicates with the first adjustment channel 16. In this embodiment, the other end of the first adjustment channel 16 communicates with the bottom 151 of the recess 15 so as to communicate with the first adjustment room P1.

The cover 30 is used to seal the outer side of the recess 15. A second adjustment room P2 is defined between the cover 30 and the elastic membrane 20. The second adjustment room P2 communicates with the second adjustment channel 17. In this embodiment, the other end of the second adjustment channel 17 communicates with the side wall 152 of the recess 15 and is located between the elastic membrane 20 and the cover 30 so as to communicate with the second adjustment room P2.

The middle-speed oil needle 40 is screwed to the first connection hole 12. The middle-speed oil needle 40 has a jet channel 41 therein to communicate with the air passage 11. The middle-speed oil needle 40 has an annular groove 62 corresponding in position to the second connection hole 13 and a plurality of through apertures 43 disposed between the annular groove 62 and the jet channel 41. The first end of the second adjustment channel 17 communicates with the first connection hole 12 and is located corresponding to the annular groove 62 to communicate with the middle-speed oil needle 40.

The oil supply valve 50 has an oil supply pipe 51 which is threadedly connected to the second connection hole 13. The oil supply pipe 51 has an oil supply passage 511 therein. A high-speed oil needle 52 is screwed in the oil supply passage 511.

The throttle 60 comprises a slide member 61 which is slidably connected to the third connection hole 14. The slide member 61 has a threaded hole 611 therein. The threaded hole 611 is adapted to receive a low-speed oil needle 62. One end of the low-speed oil needle 62 extends out of the threaded hole 611 and is inserted in the jet channel 41 of the middle-speed oil needle 40.

Figure 7:
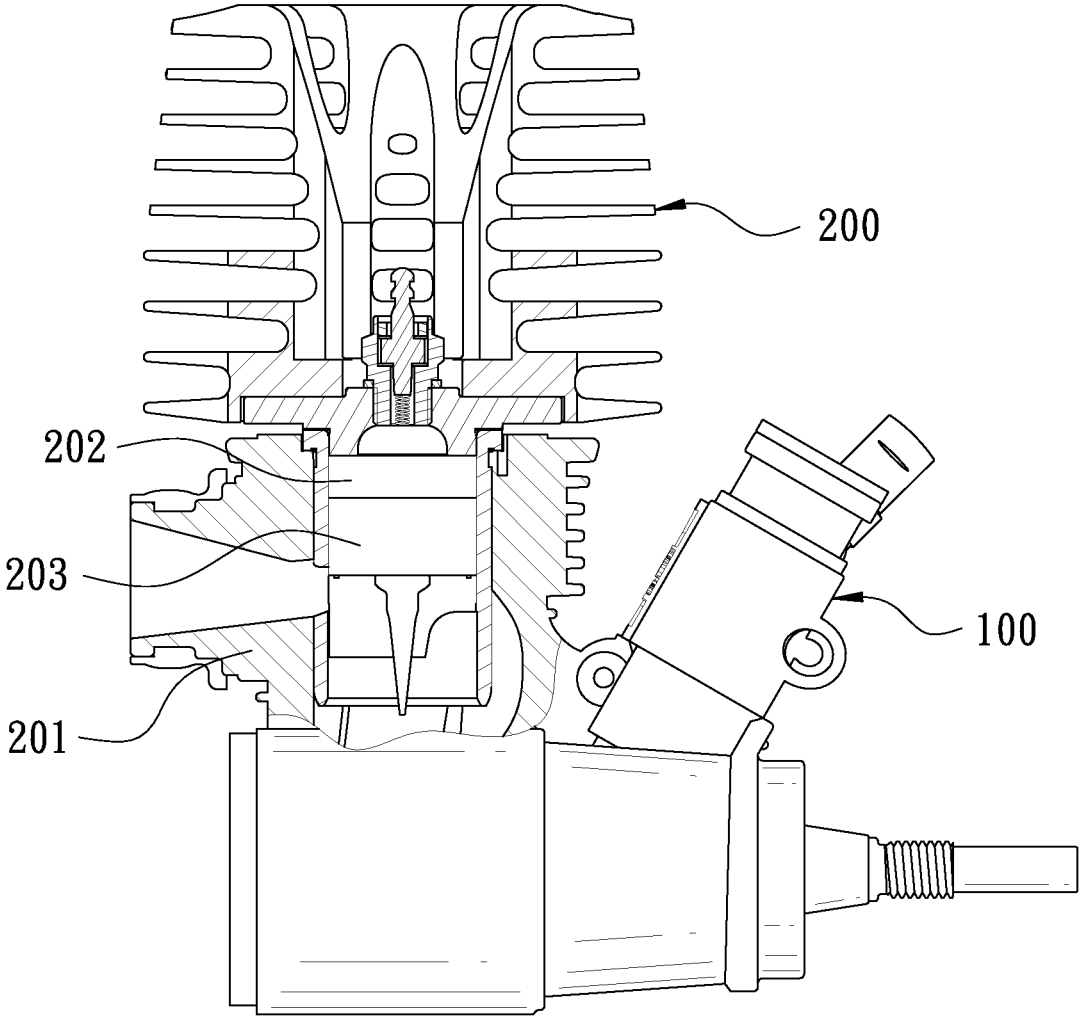
FIG. 7 is a schematic view according to the preferred embodiment of the present invention when in use.
Figure 8:
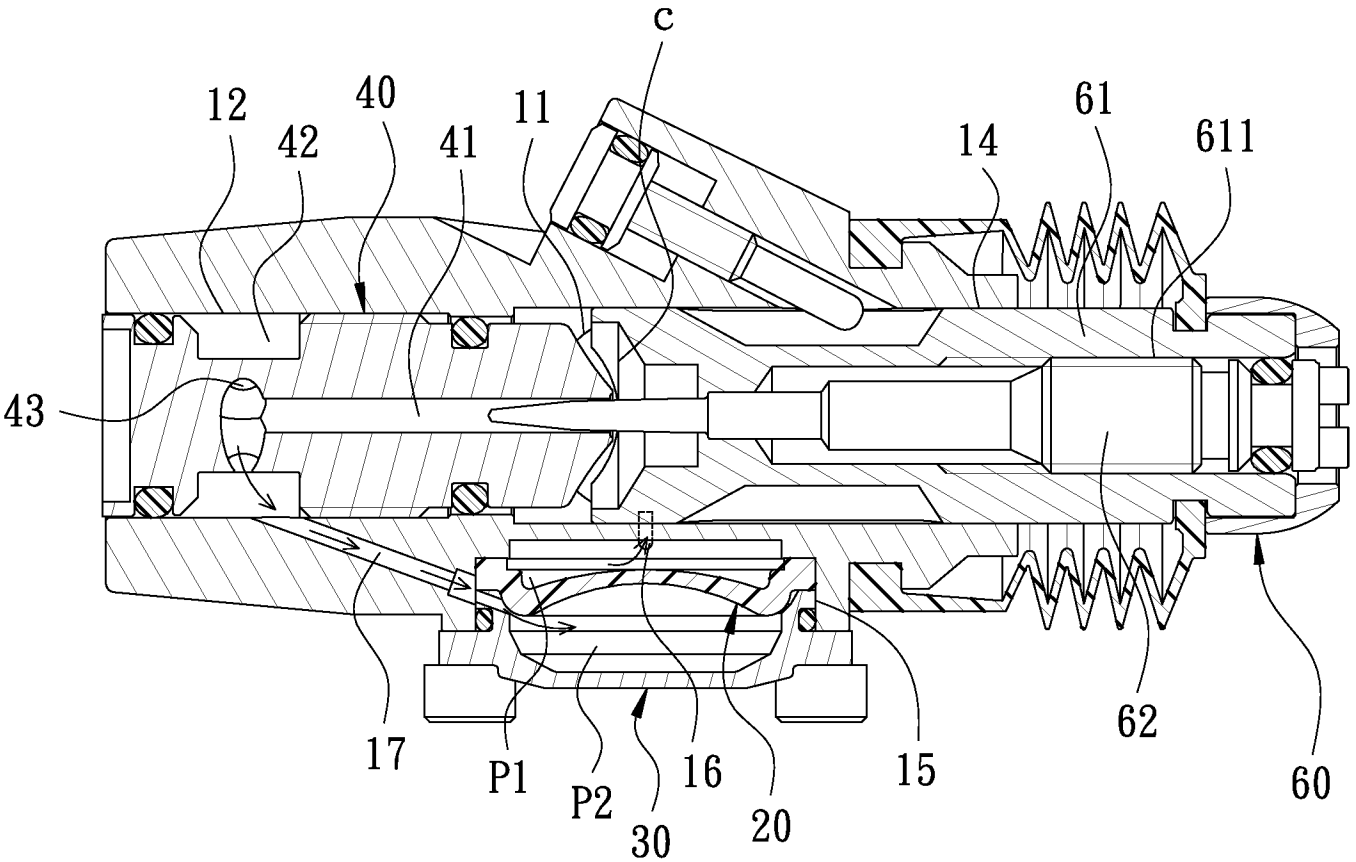
FIG. 8 is a sectional view taken along line 5-5 of FIG. 3 to show the throttle in a deceleration state.
Figure 9:
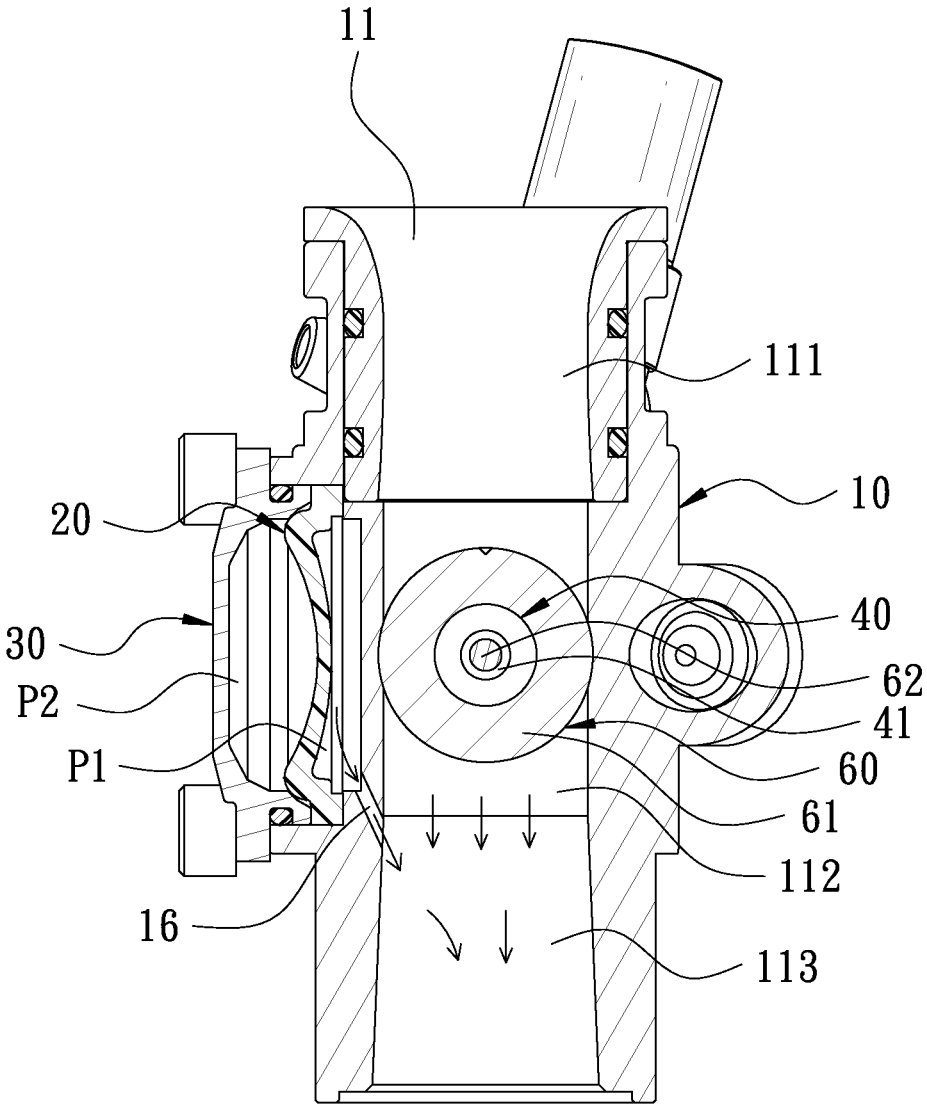
FIG. 9 is a sectional view taken along line 6-6 of FIG. 3 to show the throttle in a deceleration state.

FIG. 7 is a schematic view according to the preferred embodiment of the present invention when in use. FIG. 8 is a sectional view taken along line 5-5 of FIG. 3 to show the throttle in a deceleration state. FIG. 9 is a sectional view taken along line 6-6 of FIG. 3 to show the throttle in a deceleration state. The model engine carburetor 100 is mounted on a model engine 200. The model engine 200 comprises a cylinder 201. The cylinder 201 has a combustion chamber 202 therein. A piston 203 is slidably provided in the combustion chamber 202. Fuel oil is first poured in the oil supply passage 511 of the oil supply valve 50, and then flows to the jet channel 41 of the middle-speed oil needle 40. When the user starts the model engine 200, the external air will generate negative pressure along with the action of the piston 203 to enter the combustion chamber 202 through the air passage 11. When passing the middle section 112 of the air passage 11, because the passage C defined between the throttle 60 and the middle-speed oil needle 40 is smaller than the inlet section 111, the air will accelerate to pass the middle section 112 to form negative pressure. Through the Bernoulli principle, the fuel oil in the jet channel 41 is drawn to the middle section 112 to mix with the air to form oil gas. Then, the oil gas enters the combustion chamber 202 through the outlet section 113 for ignition to push the piston 203 to reciprocate.

It is noted that after the model engine 200 starts to run and the slide member 61 of the throttle 60 is moved toward the middle-speed oil needle 40 by the user as shown in FIG. 7, the passage C defined between the throttle 60 and the middle-speed oil needle 40 will become smaller and the air flow entering the air passage 11 will be reduced greatly. The pressure of the outlet section 113 is lowered greatly. The first adjustment channel 16 draws a great volume of the air in the first adjustment room P1 for balance. The elastic membrane 20 is deformed to generate vacuum suction, such that the fuel oil in the jet channel 41 is drawn to the second adjustment room P2 through the second adjustment channel 17 and the fuel oil from the jet channel 41 is reduced so as to adjust the ratio of the oil gas, preventing the oil gas from being too thick. Thus, the model engine 200 can run smoothly when the speed is decelerated at a very short time. The present invention prevents the model engine 200 from extinguishing because the oil gas is too thick, and reduces the carbon accumulated in the cylinder to save the fuel oil.

Figure 10:
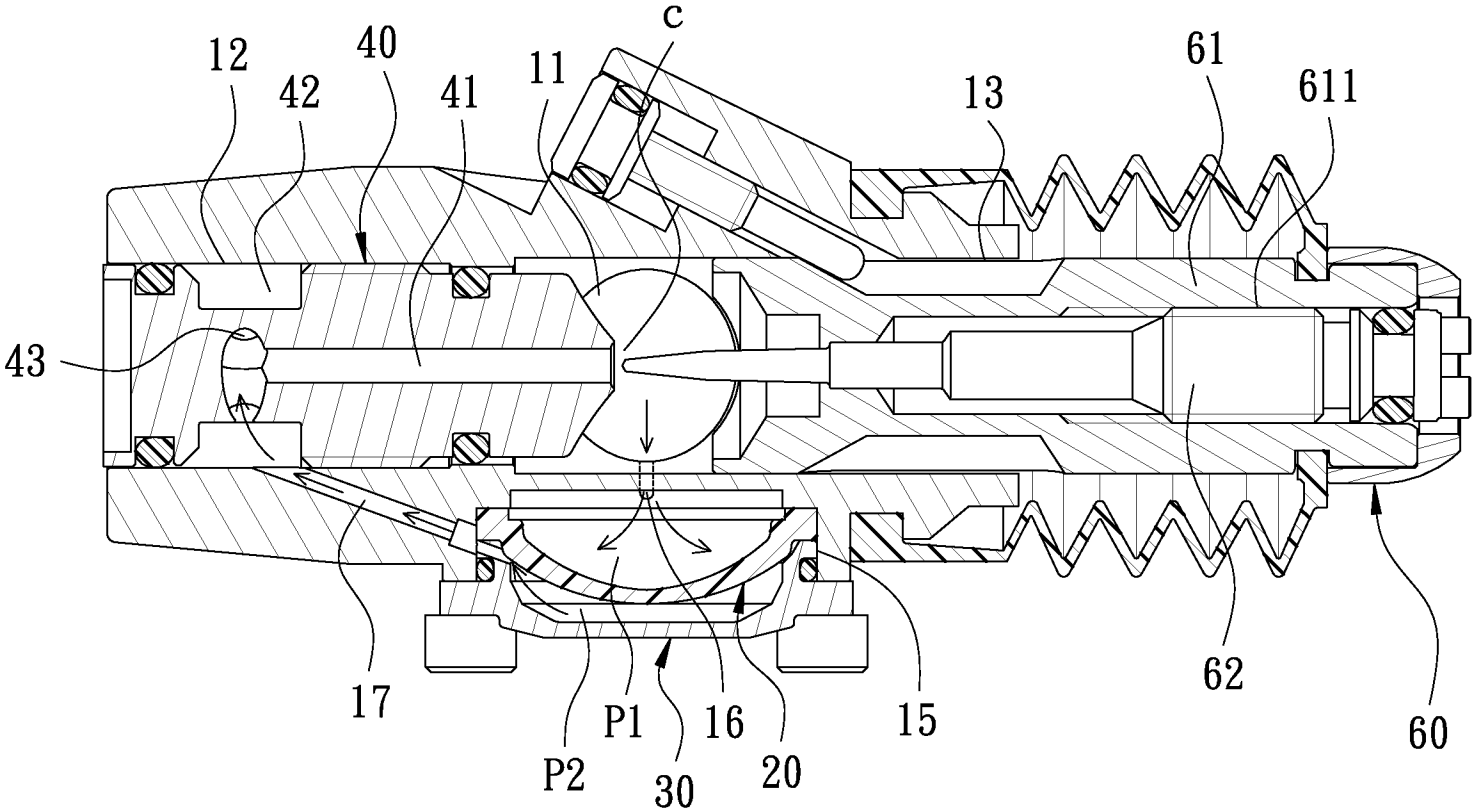
FIG. 10 is a sectional view taken along line 5-5 of FIG. 3 to show the throttle in an acceleration state.
Figure 11:
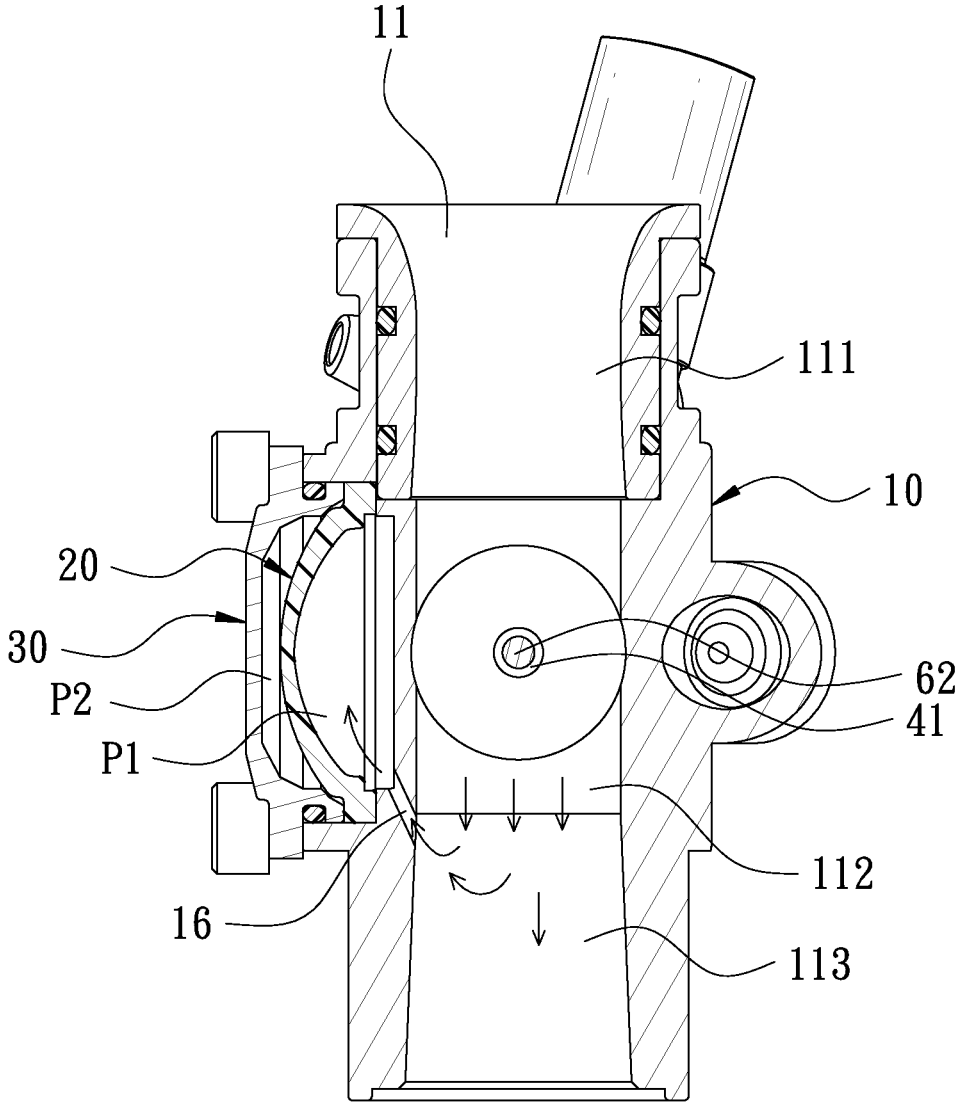
FIG. 11 is a sectional view taken along line 6-6 of FIG. 3 to show the throttle in an acceleration state.

FIG. 10 and FIG. 11 are schematic views showing the operation of the preferred embodiment of the present invention. When the slide member 61 is moved away from the middle-speed oil needle 40 by the user and the passage C defined between the throttle 60 and the middle-speed oil needle 40 becomes larger, the air flow entering the air passage 11 will increase greatly and the pressure of the outlet section 13 will rise quickly. The air flows back to the first adjustment room P1 through the first adjustment channel 16 for balance, and the elastic membrane 20 restores to its original shape. The fuel oil in the second adjustment room P2 is drawn to the jet channel 41 of the middle-speed oil needle 40 for reuse.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An engine model carburetor, comprising a main body, the main body having an air passage therein, the main body further having a first connection hole communicating with the air passage, the first connection hole being adapted for connection of a middle-speed oil needle, the main body further having a second connection hole communicating with the first connection hole, the second connection hole being adapted for connection of an oil supply valve, the main body further having a third connection hole communicating with the air passage, the third connection hole being adapted for connection of a throttle, and characterized by:

one side of the main body having a recess with a bottom and a side wall, the main body further having a first adjustment channel therein, the first adjustment channel having two ends to respectively communicate with the air passage and the recess, the main body further having a second adjustment channel therein, the second adjustment channel having two ends to respectively communicate with the middle-speed oil needle and the recess;

an elastic membrane disposed in the recess, a first adjustment room being defined between the elastic membrane and the bottom, the first adjustment room communicating with the first adjustment channel;

a cover to cover an outer side of the recess, a second adjustment room being defined between the cover and the elastic membrane, the second adjustment room communicating with the second adjustment channel.

2. The engine model carburetor as claimed in claim 1, wherein the air passage has an inlet section, a middle section and an outlet section in an axial direction, the middle section being located between the inlet section and the outlet section, the middle section has an inner diameter smaller than an inner diameter of the inlet section and an inner diameter of the outlet section, one end of the first adjustment channel communicating with the joint of the middle section and the outlet section to communicate with the air passage, the other end of the first adjustment channel communicating with the bottom of the recess to communicate with the first adjustment room.

3. The engine model carburetor as claimed in claim 1, wherein the middle-speed oil needle has a jet channel therein, the middle-speed oil needle having an annular groove corresponding in position to the second connection hole and a plurality of through apertures disposed between the annular groove and the jet channel, one end of the second adjustment channel communicating with the first connection hole and being located corresponding to the annular groove to communicate with the middle-speed oil needle, the other end of the second adjustment channel communicating the side wall of the recess and being located between the elastic membrane and the cover to communicate with the second adjustment room.

* * * * *